United States Patent [19]

Badat et al.

[11] 3,992,840

[45] Nov. 23, 1976

[54] FRAMELESS HOUSING

[75] Inventors: Alois Badat, Dietikon; Peter Hruby, Zurich, both of Switzerland

[73] Assignee: Orion Werke AG, Zurich, Switzerland

[22] Filed: Apr. 7, 1975

[21] Appl. No.: 565,446

[30] Foreign Application Priority Data

Apr. 10, 1974 Switzerland ..... 5056/74

[52] U.S. Cl. ..... 52/285; 52/753 D; 52/758 J

[51] Int. Cl.[2] ..... E04B 1/38

[58] Field of Search ..... 52/284, 285, 656, 753 D, 52/753 H, 753 P, 758 H, 758 J; 403/231, 281, 401; 312/214, 263

[56] References Cited

UNITED STATES PATENTS

| | | | |
|---|---|---|---|
| 2,156,347 | 5/1939 | McLaughlin | 52/282 |
| 2,175,271 | 10/1939 | Lethly | 52/753 P |
| 2,887,740 | 5/1959 | Potchen | 52/753 D |
| 3,261,493 | 7/1966 | Smith | 52/753 D |
| 3,673,674 | 7/1972 | Catulle | 29/464 |

*Primary Examiner*—Price C. Faw, Jr.
*Assistant Examiner*—William Randolph
*Attorney, Agent, or Firm*—Werner W. Kleeman

[57] ABSTRACT

A frameless housing composed of plates forming housing walls. Each plate is inwardly bent a number of times towards the inside of the housing along its side edges, possesses bevel-cut corners and the multiple angled or bent edges are each provided with a hollow channel-shaped section formed by bending, said section adjoining the associated plate side edge. A connection section bounds at the channel-shaped section and extends at an angle of approximately 45° towards the inside of the plate. Upon interconnecting each two plates which abut one another at right angles at their connection sections a sealing member can be clampingly held between the channel-shaped sections which confront one another.

8 Claims, 5 Drawing Figures

FRAMELESS HOUSING

BACKGROUND OF THE INVENTION

The present invention relates to a new and improved construction of frameless housing composed of wall-forming plates interconnected with one another by means of angled edges.

Such type housings serve, for instance, for receiving the components or devices of air climatizing installations or air venting installations, or quite generally for enclosing different types of apparatuses or machines.

With a housing of this general type there should be dispensed with the heretofore conventional fabrication of a frame composed of welded together or otherwise interconnected profile or structural rails, since the welding operation and the subsequently required alignment of the frame upon which the sheet metal walls are secured constitute an expensive operation in terms of labor costs. Additionally, fabrication of housings in the above conventional manner on a mass production basis, which housings are to be subsequently completed with the various installations or components according to the wishes of a customer, requires the expenditure of considerable costs for storage.

SUMMARY OF THE INVENTION

It is a primary object of the present invention to provide an improved construction of frameless housing which is not associated with the aforementioned drawbacks or limitations of the prior art proposals.

Another object of the present invention is concerned with the fabrication of a housing for apparatuses or the like, wherein the housing is fabricated only with wall elements without the need for a frame serving as a supporting skeleton.

There have already been proposed such type housings without frames, but the fabrication thereof is very complicated and expensive. Furthermore, in view of the fact that such housings are intended to be used for thermal- or sound-insulating devices they consist of double-wall elements with insulation material contained between the wall elements. Both plates of each wall element have the edges assembled together at an edge fold and both plates of each wall element form, with respect to the outside, continuous or endless upstanding or protruding flange webs by means of which, while using angle sections or rails, two wall elements located perpendicular to one another can be threadably interconnected. Separate insulation elements must then be mounted upon such type constructed housing edges and such insulation elements have to be connected by cover profile members. It should be apparent that for the housing corners, which are of complicated construction with such design, it is necessary, as concerns the sealing problem, to provide a further differently constructed cover profile member, and wherein it is also necessary that the housing corners and likewise the edges between two corners must be inclined and cannot be constructed to possess a right-angle configuration.

In contast thereto, it should be possible in accordance with the invention, while dispensing with any type of connection profile, insulation element and cover profile, to be able to join together into a housing respective wall elements each comprising only one component, and which housing is completely sealed with respect to the outside. In order to obtain the foregoing the frameless housing composed of wall-forming plates connected at angled edges is manifested by the features that each plate is rearwardly flexed or bent along its side edges with respect to the inside of the housing, cut at a bevel or mitered at the corners and is provided with multiple-angled edges which in each case possesses at a respective plate-side edge a section or portion constructed as a hollow channel formed by an angling or flexing operation and a connection section bounding thereat which extends at an angle of approximately 45° with respect to the inside of the plate. By interconnecting each two plates of the housing which abut one another at right angles by means of their abutting connection sections of the edges there can be clamped a seal between the mutually confronting channel-shaped constructed sections.

These plates can be assembled together into a housing without the need to resort to auxiliary means merely by threadably connecting the abutting edge sections. Also the problem with respect to sealing of the housing is solved in a very simple manner because there are no auxiliary means required for the attachment of the seal, rather such seal is fixedly held by the interconnected plates. Since the edges of the plate are bent back towards the inside completely about the periphery thereof there also can be inserted or mounted an insulation- or sound-dampening mat held by the edges.

According to an advantageous manifestation of the invention the edges of the wall-forming plates are each provided with an attachment section which in each case adjoins along a bending edge formed by bending at the connection section extending at an angle of 45° towards the inside of the plate. Each attachment section extends substantially parallel to the inside of the plate and serves for attaching an additional inner plate for a double-wall housing which may not be required in every instance, or for the attachment of housing components or installations.

In order to render the plate extensively resistant to bending the plate is advantageously bent at an angle of 180° about its periphery. In this way there is formed, according to a preferred constructional manifestation, the hollow channel-shaped edge section from a strip by bending through an angle of 180° and which strip bears against the inside of the plate and a further strip which extends approximately at right-angles thereto, which strips collectively delimit or bound a longitudinal channel of substantially triangular cross-section and serving for the reception of the seal.

In order to produce the housing, the plates which are oriented at right-angles to one another must only be threadably connected at their abutting edges, and it is for this reason that the plates are advantageously provided in their flat surface with bores for the access to such screws or threading members which, according to a preferred construction, piercingly extend through plastic shoes, each of which are clamped between the inside of the plate and the associated edge, so that all wall-forming plates can be assembled and disassembled from the outside.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
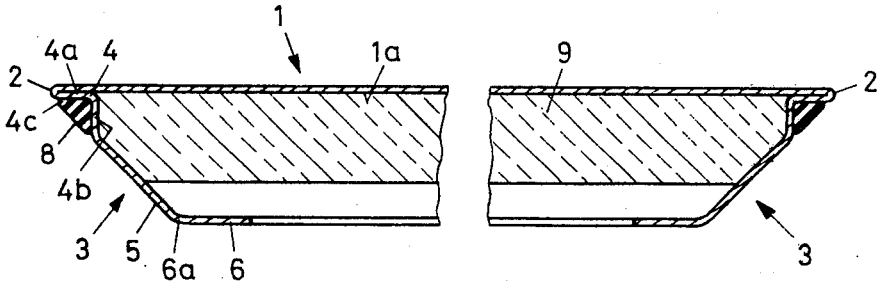
FIG. 1 is a cross-sectional view of a plate forming a wall.
Figure 3:
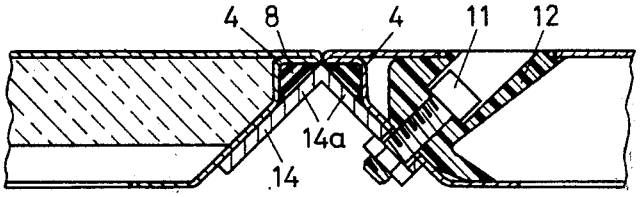
FIG. 3 illustrates two interconnected plates of the type shown in FIG. 1 and located in the same plane.
Figure 4:
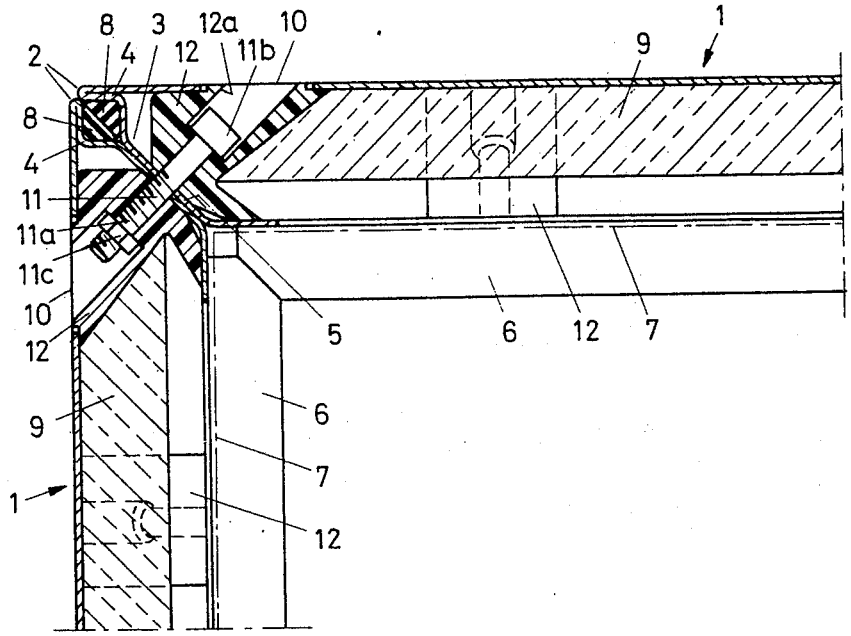
FIG. 4 is a cross-sectional view through one side of the housing taken substantially along the line I—I of FIG. 2.
Figure 5:
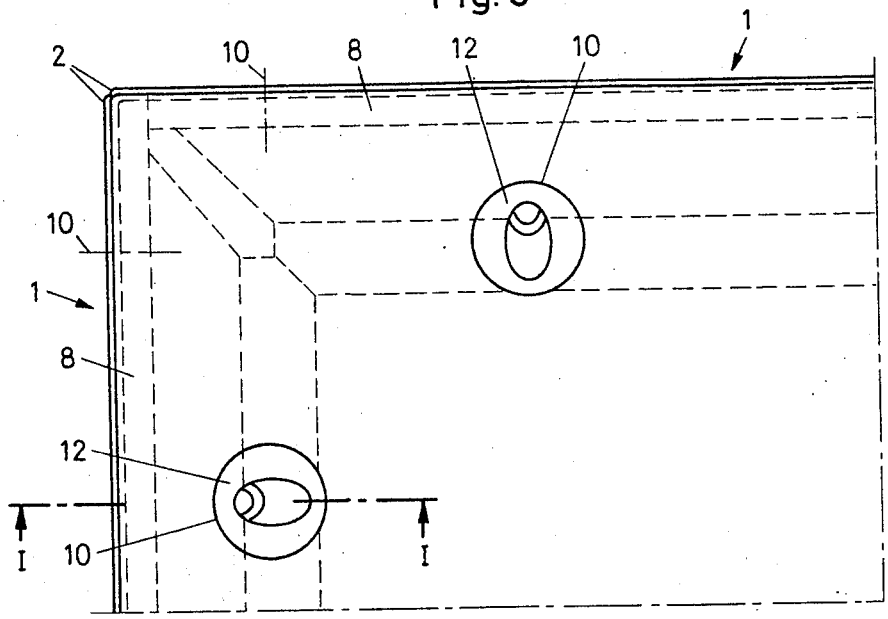
FIG. 5 is a top plan view of the housing side shown in FIG. 4.

Describing now the drawings, a plate or plate member 1 illustrated in sectional view in each of FIGS. 1, 3 and 4 and in FIG. 5 in plan view from the outside of the housing 50 (FIG. 2) serves to form a wall of the housing. Each such plate 1 is preferably of rectangular, square or quadratic configuration and possesses along its side edges 2 the borders or edges 3 which are flexed or angled a number of times and bent back towards the inside of the housing. As best seen by referring to FIGS. 4 and 5, the edges 3 are bevel cut or mitered at the plate corners, so that the bent-back edges of the side edges extending at right-angles to one another of the same plate join one another at the corners. The four edges or borders 3 of each plate 1 are angled or flexed a number of times, and specifically they possess at a location following or adjoining the side edge 2 a hollow channel-shaped section or portion 4, then a connection section or portion 5 bounding thereat and extending at an angle of approximately 45° towards the inside of the plate 1, and additionally an attachment section or portion 6 bounding along a further bending edge. This attachment section 6, which extends substantially parallel to the inside of the plate and may serve for the connection of an inner plate 7, only indicated schematically in phantom lines in FIG. 4, when there is required a double-wall construction of the housing for special applications in order, for instance, in the case of air climatizing apparatuses installed in hospitals to be able to clean the inside of the housing with a suitable antiseptic agent. Further, the attachment section or portion 6 of an edge or border may serve for the connection of components or installations in the housing, such as for instance motor brackets, or as guide track means for insertable filter cartridges or a heat exchanger element and so forth.

The hollow channel-shaped constructed edge section or portion 4 consists of a strip or ledge **4*a* which upon bending through approximately 180° bears against the inside 1*a* of the plate 1 and a strip or ledge 4*b* extending approximately at right-angles to the first-mentioned strip 4*a*. The strips 4*a* and 4*b* collectively delimit or bound a longitudinal channel 4*c* of approximately triangular cross-sectional configuration and such longitudinal channel serves for the reception of a suitable sealing cord or element 8 which in this case is likewise advantageously triangularshaped in cross-section. Due to the aforedescribed bending of the strip 4*a* through 180° the plate 1 has imparted thereto a particularly good dimensional stability and strength against bending, especially at the corners. By means of the four flexed-back or rearwardly bent edges 3 of each plate 1 there is fixedly held an insulation mat or a sound dampening mat, generally indicated by reference character 9, which bears against the inside 1*a* of the plate 1**.

Figure 2:
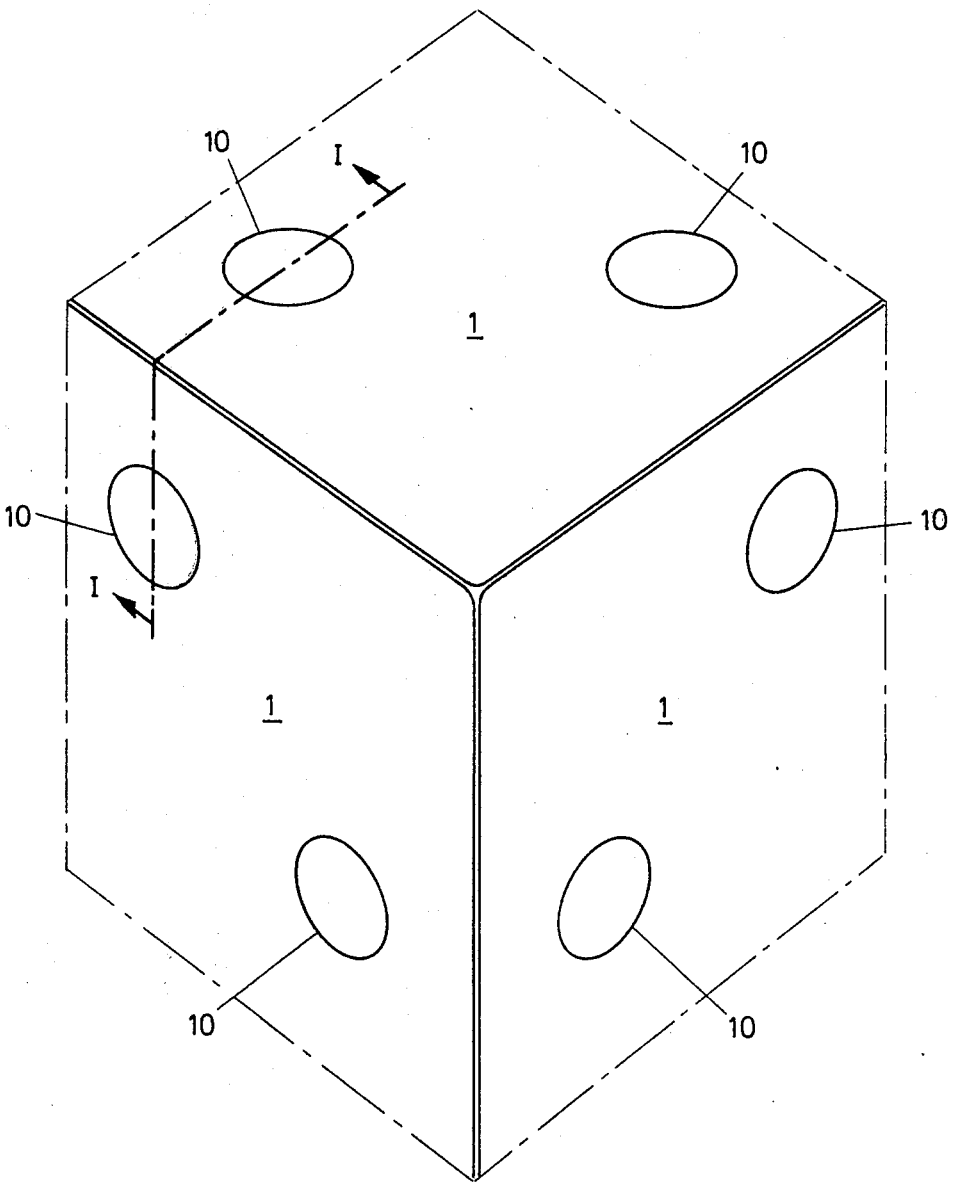
FIG. 2 is a perspective view of a housing corner.

In order to produce a frameless housing 50 as contemplated by the invention, a corner of which has been shown in perspective view in FIG. 2, plates 1 of the type heretofore described and arranged at right-angles or perpendicular to one another are threadably connected by suitable fastening means, such as threaded bolts or screws 11, at their abutting connection sections 5 of the edges or borders 3, as particularly well seen by referring to FIG. 4. In order to be able to assemble and disassemble each plate 1 from the outside there are provided at each plate near the region of its corners the bores or apertures 10, beneath which there is clampingly held in each instance a respective plastic shoe or member 12 between the inside **1*a* of the plate and the associated edge 3. Each such plastic shoe 12 engages from the inside into the associated bore 10, so that it is held non-displaceably and at the same time seals such bore. Each plastic shoe 12 possesses a stepped through-passage bore 12*a*, so that a respective connection screw 11 or equivalent fastening device piercingly extends with its shaft 11*a* through two plastic shoes 12 which are situated opposite one another near the housing corners, the screw head 11*b* being countersunk in the one plastic shoe whereas the nut member 11*c* or the like is countersunk in the other plastic shoe. By means of these plastic shoes 12 the housing is also sealed at all of the thread connection locations. A further advantage resides in the fact that the threading or threadable connection is possible from both sides, something which would not be possible when using a different connection technique, for instance when using a sheet metal strip clamped beneath the one edge and having a bore for a self-threading screw which must be inserted from the other side. Additionally, such type screw cooperating with a clip-like sheet metal strip would be more troublesome and difficult to dismantle, since it would fall into the housing 50** when disconnected unless there were used a magnetic screw driver. Such difficulties are thus eliminated with the connection technique contemplated by the invention when using the plastic shoes. Moreover, there is present the additional advantage that all plates needed for producing the housing are the same, and therefore, can be retained in storage in a finished mounted condition.

Due to the threadable interconnection of two plates disposed at right-angles to one another there are fixedly clampingly held between both hollow channel-shaped constructed edge sections 4 of both plates, two sealing cords 8, each of which in cross-section is triangular, so that the housing is completely sealed towards the outside. It would be possible also to only use one sealing cord or the like of square cross-sectional configuration. It is to be appreciated that it is possible to obtain sealing of the housing 50 owing to the described construction with simpler means and in a better manner than possible with the heretofore known prior art housings of such type. A further advantage of the disclosed construction of the plate edges in contrast to those of the prior art housings resides in the fact that the formation of water of condensation, when using the housing for air conditioning units or installations, and which condensation water has frequently formed for quite some time along the housing edges owing to the different prevailing inside and outside temperatures, can be prevented with the novel housing of this development, since with such housing there is not formed at the corners and longitudinal edges of the housing any cold bridges owing to the insulation which extends up to the region of the side edges.

If there should be fabricated a housing with larger walls than the available plate shapes, then two plates 1 arranged in the same plane and with their side edges abutting one another, as best seen by referring to FIG. 3, are interconnected by an angle section or angle rail member 14, the legs 14*a* of which are for instance threadably connected with a respective inclined connection section 5 of the plate edges, and such legs clampingly hold a respective seal 8 in the hollow channel-shaped sections or portions 4 of both plate edges. Furthermore, in order to have access at any time to the interior of the housing there is generally provided one plate which is detachable and serves as a control cover, and which has been conveniently omitted from the drawings to preserve clarity in illustration. Such a plate may be provided with locking elements which can be actuated by a rotatable handgrip or the like, the locking elements engageable in bores at the plate edge, so that the plate can be completely removed when the locking elements are disengaged.

The previously described construction, apart from the already mentioned advantages, in particular possesses the advantage in contrast to housing constructions of the prior art having a frame formed of profile rails and heretofore most frequently used, that due to holding in storage or inventory individual wall elements instead of finished housings there can be realized a considerable saving in space and thus also a saving in costs.

While there is shown and described present preferred embodiments of the invention, it is to be distinctly understood that the invention is not limited thereto, but may be otherwise variously embodied and practiced within the scope of the following claims. Accordingly:

What is claimed is:

1. A frameless housing comprising a plurality of wall-forming plates, each of said plates having side edges and multiple flexed edges, each plate being rearwardly flexed along each of its side edges towards the inside of the housing to form said multiple flexed edges, each multiple flexed edge being mitered at its corners, each multiple flexed edge adjoining an associated side edge of its respective plate, each multiple flexed edge having a flexed portion forming a channel-shaped section and a connection section merging into said channel-shaped section, said connection section extending at an angle of about 45° towards the inside of the plate, means for connecting two plates which abut one another at right-angles at the region of their abutting connection sections, and a seal clampingly held between the channel-shaped sections of said two right-angular abutting plates, the channel-shaped sections of said two right-angular abutting plates mutually confronting one another, each channel-shaped section comprising a first strip of the multiple flexed edge bent through 180° and bearing against the inside surface of the plate and a second strip of the multiple flexed edge extending at right-angles to said first strip, said strips delimiting a longitudinal channel defined by said channel-shaped section for receiving said seal, said longitudinal channel having a substantially triangular cross-section.

2. The housing as defined in claim 1, wherein each of the flexed edges of the wall-forming plates includes an attachment section integrally formed therewith and adjoining an associated connection section, said attachment section bounding said associated connection section along a bending edge and extending substantially parallel to the inside of the plate.

3. The housing as defined in claim 2, wherein the attachment section serves for connecting an inner plate for a double-wall housing.

4. The housing as defined in claim 2, wherein the attachment section serves for the connection of housing components.

5. The housing as defined in claim 1, wherein said connecting means comprise screws and wherein two of said plates of the housing are threadably connected by said screws with one another at their abutting connection sections, said plates having bores for the access to said screws from the exterior of the housing.

6. The housing as defined in claim 5, further including a plastic shoe member provided for each bore, said plastic shoe member being clamped between the flexed edge and the inside of the plate, said plastic shoe member engaging from the inside into the bore and thereby being non-displaceably held therein and sealing the bore, said plastic shoe member having a stepped throughpassage bore for receiving the screw shaft and the screw head or a nut member respectively.

7. The housing as defined in claim 1, whrein two plates of the housing are substantially coplanar and abut one another at their side edges, said two coplanar plates being interconnected by an angle profile rail member, said angle profile rail member having legs, means for threadably connecting said legs with a respective inclined connection section of the flexed edges of said two coplanar plates, and a seal clampingly held in each of the channel-shaped sections of the flexed edges of said two coplanar plates.

8. The housing as defined in claim 1 wherein another one of said wall-forming plates abuts each of said two right-angular abutting plates at right-angles to form a corner of said housing.

* * * * *